US007581660B2

(12) United States Patent
Nay et al.

(10) Patent No.: US 7,581,660 B2
(45) Date of Patent: Sep. 1, 2009

(54) DRIP-RESISTANT PIPETTING DEVICE AND DRIP-RESISTANT PIPETTING METHOD

(75) Inventors: Renato Nay, Masein (CH); Markus Bentz, Chur (CH); Rene Ackermann, Chur (CH)

(73) Assignee: Hamilton Bonaduz AG (CH)

( * ) Notice: Subject to any disclaimer, the term of this patent is extended or adjusted under 35 U.S.C. 154(b) by 400 days.

(21) Appl. No.: 11/272,333

(22) Filed: Nov. 9, 2005

(65) Prior Publication Data

US 2007/0102445 A1 May 10, 2007

(51) Int. Cl.
*B67D 5/08* (2006.01)

(52) U.S. Cl. ..... 222/61; 222/1; 222/386.5; 222/389; 422/100; 73/864.01; 73/864.11

(58) Field of Classification Search ..... 222/52, 222/61, 63, 571, 1, 386.5, 389, 394, 399, 222/334; 422/99, 100; 137/487.5; 73/864.01, 73/864.16, 864.18, 864.11, 863.01; 417/44.2
See application file for complete search history.

(56) References Cited

U.S. PATENT DOCUMENTS 5,499,545 A * 3/1996 Kimura et al. ..... 73/864.18
7,314,598 B2 * 1/2008 Nishino ..... 422/100

* cited by examiner

*Primary Examiner*—Frederick C. Nicolas
(74) *Attorney, Agent, or Firm*—Audrey A. Millemann; Weintraub Genshlea et al.

(57) ABSTRACT

A liquid-metering device is disclosed, in particular, a pipetting device for aspirating and dispensing liquids. The device comprises a vessel which is at least partially filled with gas and has an opening through which liquid is received or discharged, a gas-pressure-changing device for changing the gas pressure in the vessel, a state-variable-detecting device for detecting at least one state variable of the gas in the vessel, and a control device which activates the gas-pressure-changing device as a function of the state variable detected by the state-variable-detecting device. The control device is a regulating device which, during a regulating time segment between liquid reception and liquid discharge, activates the gas-pressure-changing device as a function of the detected state variable such that the actual gas pressure in the vessel is kept essentially at a predetermined gas pressure.

3 Claims, 4 Drawing Sheets

DRIP-RESISTANT PIPETTING DEVICE AND DRIP-RESISTANT PIPETTING METHOD

Figure 1:
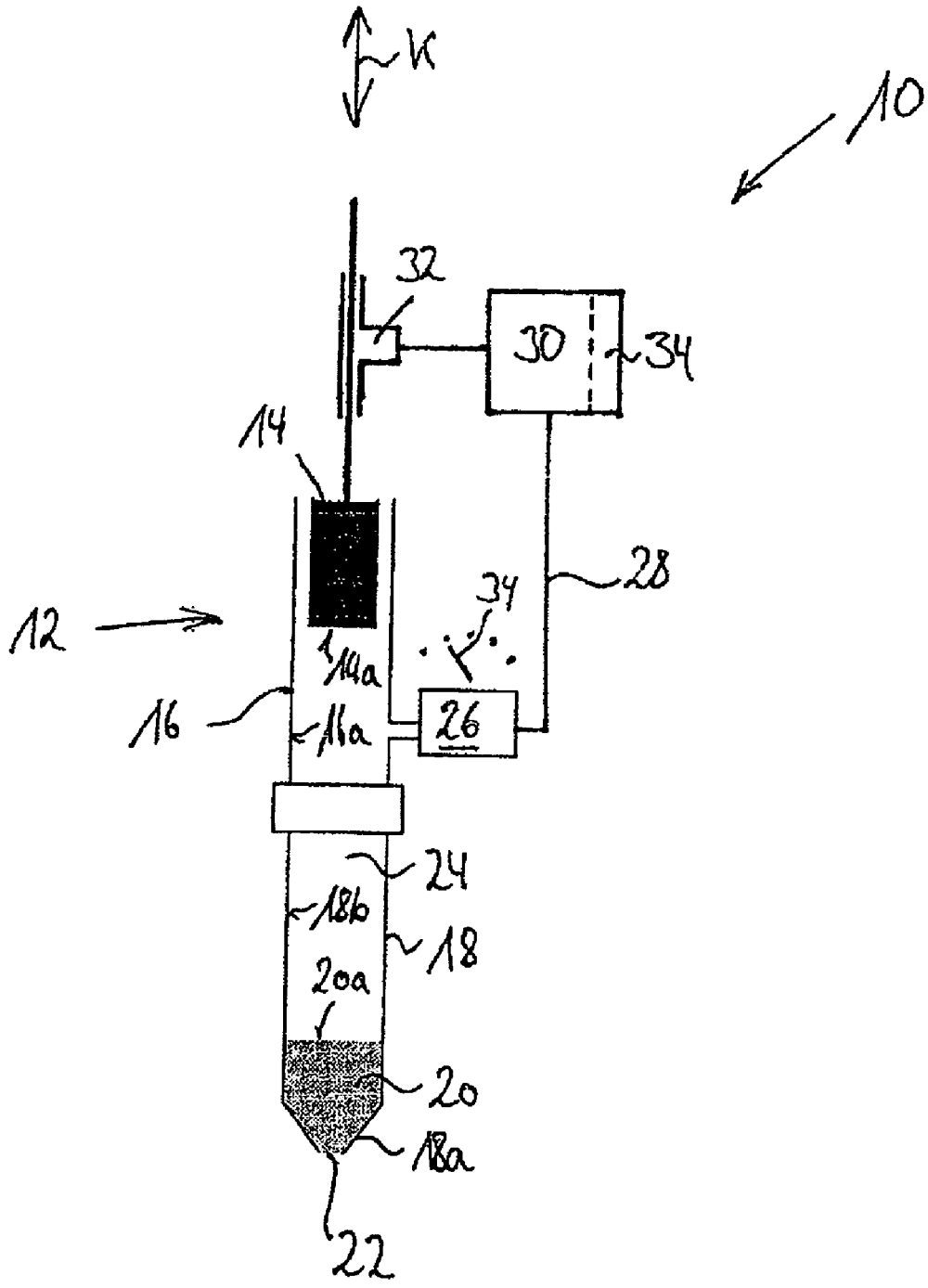

The present application relates to a liquid-metering device, in particular pipetting device for aspirating and dispensing liquids, the device comprising:

- a vessel which is at least partially filled with a gas and has an opening through which liquid is received into the vessel or is discharged therefrom, the quantity of the gas, when liquid is received, being enclosed by vessel walls and the liquid itself,
- a gas-pressure-changing device for changing the gas pressure in the vessel,
- a state-variable-detecting device for detecting at least one state variable of the gas in the vessel, and
- a control device which activates the gas-pressure-changing device as a function of the state variable detected by the state-variable-detecting device.

The present invention furthermore relates to a method for avoiding losses of drops in the case of liquid-metering devices.

A device of the type mentioned at the beginning is known from DE 44 21 303 A1. This discloses a pipetting device which sucks a quantity of liquid into a section of a pipette tip or releases it therefrom. This takes place by changing the gas pressure of a gas enclosed between a plunger, cylinder walls and the liquid.

In order to be able to pick up the quantity of liquid as precisely as possible, the pressure of the enclosed gas and the prevailing ambient pressure are measured. From the measured values and with the geometrical form of the cylinder and of the pipette tip being taken into account, a correction value is calculated in order as precisely as possible to obtain the distance to be covered by the plunger as a desired value for the controlling means of the plunger movement. The controlling means then causes the plunger to move on the basis of the corrected desired value.

Furthermore, it is conceivable, according to the disclosure of DE 44 21 303 A1, also to monitor the pressure of the gas between plunger and quantity of liquid between the ending of the liquid reception and the beginning of the liquid discharge in order to ascertain whether the pipette or the like is leaking.

Furthermore, WO 97/02893 A1 discloses a method and a device for correcting a temperature-dependent error in the metering of a liquid from a pipette. The known device comprises two chambers which are connected in series to each other by a gas passage, namely a first chamber in the pipette tip and a second chamber in the plunger-cylinder system, to which the pipette tip is connected. The pipette tip, which is provided with an opening, is dipped into the liquid in order to pick up liquid. A vessel wall of the second chamber is formed by a movable plunger. The second chamber is completely filled, and the first chamber is at least partially filled, with a gas. The quantity of gas is enclosed in the two chambers between plunger and liquid.

In order to correct a temperature-induced error in the volume of the liquid sucked up, WO 97/02893 A1 proposes measuring the change in temperature in the gas flowing from the first to the second chamber on account of the movement of the plunger when the liquid is being picked up, and correcting the change in volume, which is caused in the second chamber by the movement of the plunger, on the basis of the measured change in temperature during the liquid-receiving operation. At least one temperature sensor is provided for this. The method disclosed in WO 97/02893 A1 is only used for correcting the movement of the plunger during the liquid reception.

Reference should be made to EP 0 747 689 B1 as further prior art. This shows a device and a method for removing a liquid from a sealed container. In addition to the liquid, the sealed container contains a quantity of gas. When the liquid is removed from the container, the gas pressure in the interior of the container is monitored by a pressure sensor. The gas pressure in the interior of the sealed vessel is brought beforehand to ambient pressure by the seal being pierced with a hollow needle.

The present application is based on the following problem:

In the case of vessels in which a quantity of liquid is discharged or received by changing the pressure of a gas enclosed by vessel-walls and the liquid, the liquid is sometimes kept for a considerable amount of time in the vessel between a liquid-receiving operation and a liquid-discharging operation, for example in order to negotiate transportation distances. During this time, the difference in pressure between the ambient pressure and the pressure of the enclosed quantity of gas and frictional and adhesive forces acting between liquid and wetted wall keep the liquid in the vessel. In this case, the difference in pressure between the ambient pressure and the gas pressure in the interior of the vessel has the greatest share of the force keeping the liquid in the vessel.

While the liquid is kept in the vessel, the pressure of the gas enclosed in the vessel can change due to evaporation or due to temperature equalization operations.

If, for example, liquid which has been received is evaporated, then the gas pressure in the vessel rises. In this case, the gas pressure generally rises more severely than the weight of the liquid which has not yet evaporated decreases.

If a hot liquid is received in the vessel, then it cools with heat being given off to the gas enclosed in the vessel. This heating of the gas leads in turn to a rise in the pressure of the enclosed gas.

The operations described may lead to some of the quantity of liquid which has been received being undesirably pushed out of the vessel by the undesired increase in the gas pressure. The liquid which has been pushed out then drips from the vessel. As a result, in spite of quantities of liquid having initially been correctly received, this may lead undesirably to erroneous quantities of liquid being discharged.

It is therefore the object of the present invention to provide a technical teaching, with which a liquid metered into a vessel can be kept in the vessel for a long period without loss of drops. As a result, for example, large transportation distances can be covered or the liquid-metering device can be kept without loss of metered liquid after the liquid has been received, for important operations required in the short term.

According to a first aspect, this object is achieved by a liquid-metering device of the generic type, in which the control device is a regulating device which is designed, at least during a regulating time segment between liquid reception and liquid discharge, to activate the gas-pressure-changing device as a function of the detected state variable in such a manner that the actual gas pressure in the vessel is kept essentially at a predetermined desired gas pressure during the regulating time segment.

In this application, "essentially" is intended to cover slight deviations, for example tolerance-induced deviations or deviations which can be attributed to the regulating method used in each case (e.g. 2-position regulation).

It suffices to regulate the gas pressure in the vessel to a predetermined desired gas pressure only over a time segment and not over the entire time between liquid reception and liquid discharge, since evaporation processes or temperature equalization processes proceed slowly. In addition, in the case of both processes, a state of equilibrium arises over time, with the result that the change in the unregulated gas pressure by evaporation or change in temperature over time does not take place at a constant speed, but rather at a decreasing speed.

The gas pressure is preferably kept at a predetermined desired gas pressure in a regulating time segment, which regulating time segment comprises a time domain in the first half, preferably in the first quarter, of the period of time lying between the final moment of the liquid-receiving operation and the moment of starting the liquid-discharging operation. The evaporation and temperature equalization processes proceed here at their most rapid and cause a more rapid change in the gas pressure compared with a later time segment between liquid reception and liquid discharge. It is therefore furthermore advantageous, in order to reliably prevent dripping, if the regulating time segment comprises the first quarter, or particularly advantageously the first half of the period of time lying between the final moment of the liquid-receiving operation and the moment of starting the liquid-discharging operation.

In the case of particularly sensitive liquids, the greatest possible security during the retention phase between liquid-receiving operation and liquid-discharging operation can be achieved if the regulating time segment comprises the entire period of time lying between the final moment of the liquid-receiving operation and the moment of starting the liquid-discharging operation.

Since it is to be presumed that the correct quantity of liquid has been received, a loss of drops of liquid during the retention phase between liquid-receiving operation and liquid-discharging operation can be avoided in a simple manner if the predetermined desired gas pressure is smaller than or equal to a gas pressure prevailing in the vessel at the final moment, or near in time to the final moment, of the liquid-receiving operation.

However, it may be advantageous firstly to allow dynamic effects on the gas caused by the movement of the liquid to subside and to use a later gas pressure, which is detected after the final moment of the liquid-receiving operation, as desired gas pressure. How close in time the gas pressure used as the desired gas pressure and prevailing in the vessel can preferably be to the final moment of the liquid-receiving operation depends on the parameters present in the particular metering operation, for example on a degree of saturation of the gas or on a difference in temperature between gas and liquid. It; may be assumed, however, that in the case of most metering operations, any gas pressure which is present in the vessel in the first ten seconds after the final moment of the liquid-receiving operation can be used as the desired gas pressure.

It may be conceivable in principle to detect any desired state variables of the gas, for example temperature, gas volume or gas pressure. By means of corresponding equations, such as the ideal gas equation or corresponding equations for describing adiabatic or polytropic changes in state and the like, the detected state variables can be placed into a relationship with the gas pressure prevailing in the vessel. Since, as already stated above, the difference in pressure between the ambient pressure and the pressure of the gas enclosed in the vessel takes the main share in keeping the liquid in the vessel, it is particularly advantageous to detect the gas pressure in the vessel by a pressure sensor arrangement. This supplies the greatest possible regulating accuracy. Within the context of the present application, pressure sensor arrangement is understood as meaning a device for measuring the pressure using at least one pressure sensor.

The vessel may comprise a plunger-cylinder arrangement and a pipette tip arranged thereon, with the pressure sensor arrangement then being provided on the plunger-cylinder arrangement for cost reasons. Otherwise, each pipette tip would have to be provided with a pressure sensor arrangement, and the respective pressure sensor arrangement would have to be coupled to the regulating device after receiving the pipette tip. This constitutes a considerable outlay.

It is theoretically conceivable to provide a turbine as the gas-pressure-changing device, which turbine blows gas into the vessel or blows it out of it. However, in most cases, the gas-pressure-changing device is a mechanical device with a drive and a component which is driven by the latter and forms a part of the vessel wall, so that a movement of the component leads to an increase or reduction of the gas volume in the vessel and, associated therewith, to a drop or rise of the gas pressure in the vessel. In this case, one direction of movement of the component is associated with a change in direction of the gas pressure, i.e. rising or dropping. Frequently, in the event of a reversal of the direction of movement of the component, a movement play has to be overcome.

The abovementioned movement play may in turn be a cause of inaccuracies in the quantity of liquid received or discharged, for example if the quantity of liquid discharged or received is calculated with reference to the movement of the drive or other detected variables associated with the drive. This is because, due to the movement play, there are driving activities which actually do not cause any change in the gas pressure and therefore any change in the quantity of liquid present in the vessel.

The inaccuracy thus possibly occurring in the quantity of liquid received by the vessel or discharged therefrom can be reduced or even eliminated in an advantageous manner by the fact that the regulating device is designed in such a manner for determining the movement play that it drives the drive, following a first driving direction, in an opposite, second driving direction until the state-variable-detecting device detects a change in the at least one state variable.

In order to make it possible for the gas pressure to be determined as precisely as possible, the regulating device can be designed to activate the drive stepwise during the determining of the movement play. As a result, it is possible to allow dynamic effects to subside before a detection of the gas pressure in the interior of the vessel.

The advantage of a liquid-metering device designed in such a manner furthermore resides in the fact that each liquid-metering device can individually determine its system-inherent movement play. The liquid-metering device preferably comprises a memory device, so that the individually determined movement play can be stored therein and can be retrieved as required. If the liquid-metering device is conceived for use under changing ambient conditions, movement plays can be determined together with further variables, so that determined movement plays are stored in the memory device as a function of further variables. Thus, the movement play can be stored as a function of different ambient temperatures and/or ambient pressures and/or periods of operation and/or component positions etc. It is furthermore advantageous first of all to determine the particular movement play prior to a value-exhausting use with reference to a metering of test liquids, such as, for example, water or the like, so that the movement play is then known in the actual metering operation. This avoids a loss of possibly valuable liquids during the determining of the movement play.

The abovementioned component which can be moved by the drive may be a movable piston forming a vessel wall section. However, it may also be a wall of a bellows connected to the vessel.

According to a further aspect, the abovementioned object is also achieved by a method for avoiding losses of drops in the case of liquid-metering devices, in particular pipetting devices, which method has the following steps which are carried out at least in one time segment of the period of time lying between liquid-receiving operation and liquid-discharging operation:

detecting at least one state variable of a gas, which is essentially enclosed between vessel walls and the liquid in a vessel of the liquid-metering device, which vessel receives a liquid, regulating the pressure of the gas as a function of the state variable detected in such a manner that the actual gas pressure essentially corresponds with a predetermined desired gas pressure.

Since the method is closely associated with the above-described device, for the additional explanation of the method and the advantages which can be obtained therewith reference is made to the above description of the liquid-metering device according to the invention.

It is true that the regulating step for regulating the gas pressure in the case of desired gas pressure known in advance can already begin before the end of the liquid-receiving operation. However, in order to avoid losses of drops between liquid reception and liquid discharge, it is important that the detecting step and the regulating step take place between the final moment of the liquid-receiving operation and the moment of starting the liquid-discharging operation. For the above-described reasons, the gas pressure can advantageously be regulated in a time segment which comprises a time domain in the first half, preferably in the first quarter of the period of time lying between the final moment of the liquid-receiving operation and the moment of starting the liquid-discharging operation. The greatest possible security is obtained if the detecting step and the regulating step are carried out during the entire period of time lying between the abovementioned moments.

If the liquid-metering device in question is of the previously described type, in which a component forming a vessel wall section can be driven by a drive for moving it and a movement of the component brings about a change in the gas pressure, then, in one specific refinement, the regulating step advantageously comprises an activation of the drive as a function of the state variable which is being detected.

An above-described movement play can be determined with the aid of the method according to the invention by the fact that, following a first driving direction, the drive is activated in an opposite, second driving direction until the state-variable-detecting device detects a change in the at least one state variable. In order to avoid possibly disturbing dynamic effects during the detecting of the at least one state variable, the activation of the drive in the second driving direction can take place stepwise, with a detection of the at least one state variable being associated with each activating step, and the detection of the at least one state variable preferably taking place after the activation of the drive.

The greatest possible accuracy in the determination of the movement play can be obtained by the fact that during the determination of the movement play, further variables are detected, such as, for example, the position of the component relative to the vessel and/or a temperature, in particular ambient temperature and/or the ambient pressure.

The at least one movement play determined is advantageously stored, optionally together with the previously mentioned, further variables, associated with the movement play to be stored in each case. When the need arises, the movement play can then be retrieved from the memory, optionally as a function of operating parameters currently present, and can be taken into consideration during the activation of the drive.

For the abovementioned reasons, the direct detecting of the gas pressure without detours via other state variables is of particular advantage for regulating the gas pressure.

Furthermore, it should be possible that, for the redundant detecting of the gas pressure, further state variables, such as, for example, the temperature or the gas volume, are detected and the liquid-metering device is provided with corresponding sensors. This permits a reciprocal checking of the functioning capability of the sensors used, in particular of the pressure sensor arrangement.

Figure 2A:
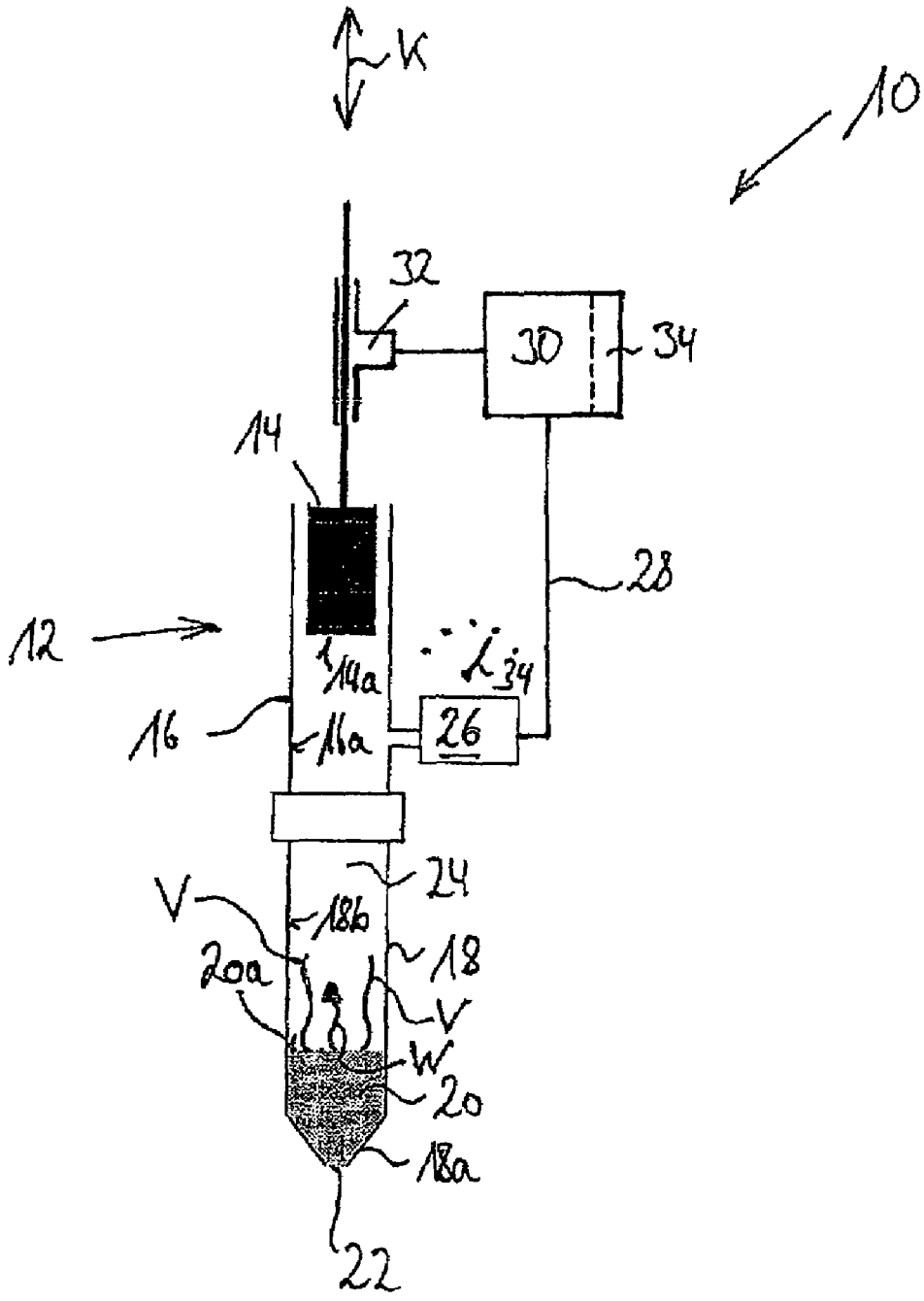
Figure 3A:
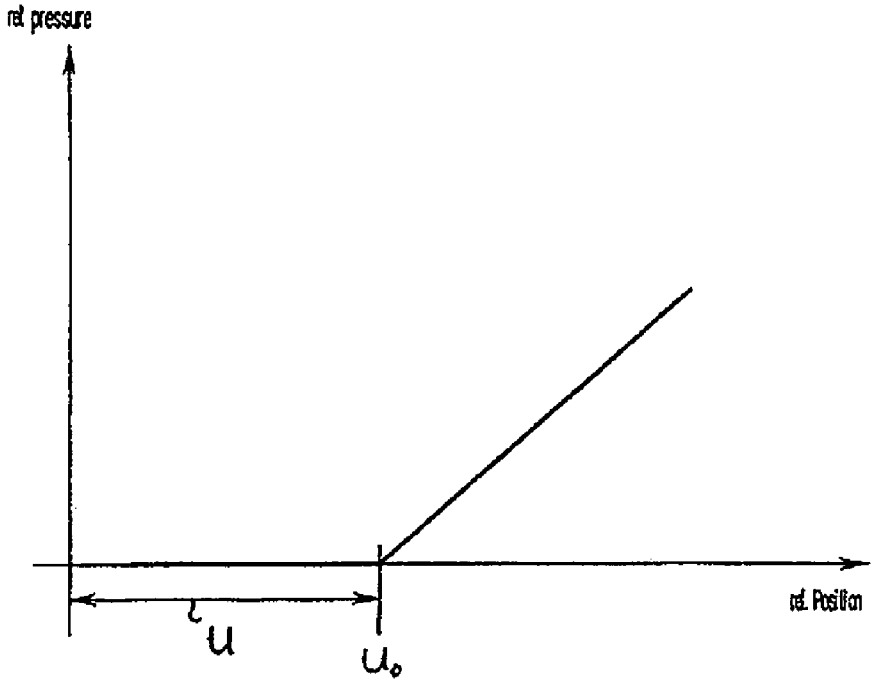

The present invention will be explained in more detail with reference to the attached drawings, in which:

FIG. 1 is a diagrammatic illustration of a liquid-metering device according to the invention, FIGS. 2*a* and *b* represent a diagrammatic sequence of regulating the gas pressure prevailing in the vessel, in accordance with the present invention, and FIGS. 3*a* and *b* represent graphs which show the relative pressure of a gas enclosed in a vessel as a function of the relative position of a movable component influencing the gas pressure, during the determination of a movement play.

In FIG. 1, a liquid-metering device according to the invention is referred to in general by 10. The liquid-metering device 10 comprises a plunger-cylinder system 12 with a plunger 14 which is guided movably in the direction of the double arrow K in a cylinder 16.

An exchangeable pipette tip 18 in which there is a liquid 20 is mounted on the cylinder 16. The pipette tip 18 together with the cylinder 16 and the plunger 14 forms a vessel receiving the liquid 20.

At the longitudinal end 18*a* remote from the cylinder, the pipette tip 18 has an opening 22 through which the liquid 20 has been received into the pipette tip 20 and from which it can be discharged again.

The plunger 14 bears against the inner wall 16*a* of the cylinder 16 in an essentially gas-tight manner. The plunger surface 14*a* pointing toward the pipette tip 18 forms a vessel boundary wall.

A gas 24, for example air, is enclosed between the liquid surface 20, the plunger surface 14*a*, the cylinder inner wall 16*a* and the inner wall 18*b* of the pipette tip. Instead of air, use may also be made of any other desired gas, for example nitrogen or an inert gas, if reactions with the liquid 20 to be received are to be avoided in every situation.

The liquid 20 has been sucked into the pipette tip 18 through the opening 22 in a manner known per se by dipping the opening 22 into a store of liquid and, with the opening dipped in, moving the plunger 14 in such a manner that the volume of the enclosed gas 24 is increased. The pipette tip 18, of FIG. 1, and also of FIGS. 2*a* and *b*, has already finished the liquid reception and is no longer dipped into the store of liquid.

A pressure sensor 26 for detecting the gas pressure of the enclosed gas 24 is connected to the interior of the vessel. Although it is, in principle, conceivable to provide a pressure sensor on the pipette tip, it is more advantageous for cost reasons to provide the pressure sensor 26 on the cylinder 16, which is not exchangeable in contrast to the pipette tip 18, and to permanently operate it.

The pressure sensor 26 detects the pressure of the gas 24 and supplies a signal representing the gas pressure via the line 28 to a regulating device 30 which is designed in order to operate a drive 32 for shifting the plunger 14 in the direction of the double arrow K, as a function of a signal supplied by the pressure sensor 26.

In this case, the pressure sensor 26 can supply an absolute value of the pressure of the gas 24 or can supply a relative value, for example with reference to the ambient pressure, to the regulating device 30. The pressure value detected by the pressure sensor 26 and supplied to the regulating device 30 is indicated by a pointer 34.

The manner in which liquid particles V evaporate from the surface 20*a* into the space occupied by the gas 24 is indicated in FIG. 2*a*. The liquid 20 also gives off heat W to the gas 24. As a result, the pressure of the gas 24 in the vessel comprising cylinder 16, plunger 14 and pipette tip 18 rises. This increase in pressure is detected by the pressure sensor 26, as is indicated by the position (changed in comparison to FIG. 1) of the pointer 34. Without a regulating intervention, this increase in pressure would result in liquid 20 being pushed out of the opening 22.

Figure 2B:
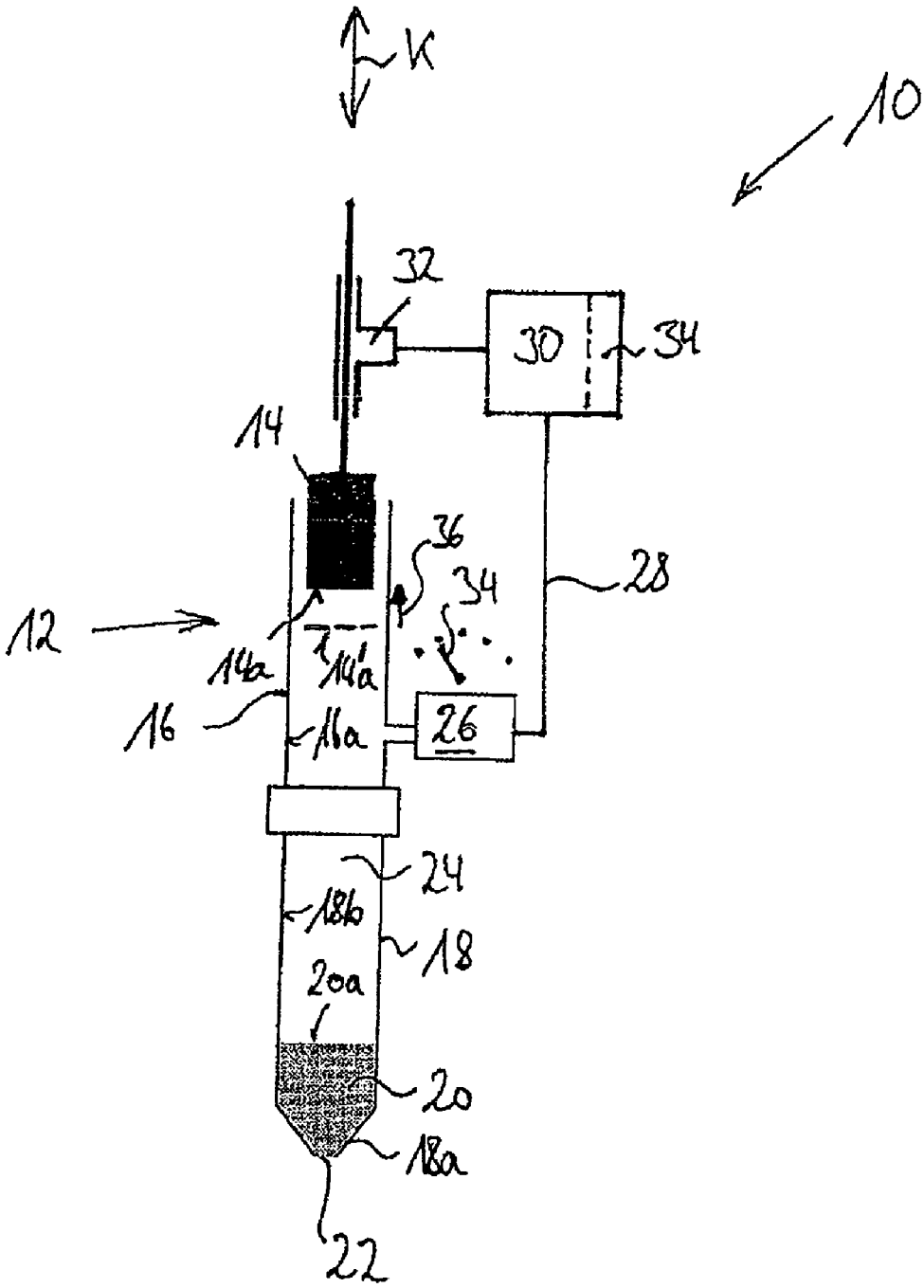

The regulating device 30 moves the plunger in the direction of the arrow 36 in FIG. 2*b* as a function of the pressure value supplied to it by the pressure sensor via the line 28, and enlarges the volume of the gas 24 in the vessel comprising the elements 14, 16, 18 until a predetermined desired gas pressure (explained further below) is reached. As a result, the increase in pressure is reduced because of evaporation and transfer of heat. The pressure of the gas 24 again reaches the value which has prevailed in the interior of the vessel comprising plunger 14, cylinder 16 and pipette tip 18 directly after the liquid 20 has been received in the pipette tip 18. The original location at which the plunger wall 14*a* was situated before the correction is indicated by 14*a'*.

As desired gas pressure, use is ideally made of the pressure prevailing in the vessel at the moment at which the liquid-receiving operation is ended. Since the increase in pressure does not generally proceed in a flash because of the evaporation and/or transfer of heat, as desired gas pressure use can generally be made of a gas pressure which prevails in the vessel within a period of 10 seconds after the end of the liquid-receiving operation.

Experts will understand that, contrary to the example described, the plunger may also be shifted toward the opening 22 in order to increase the pressure of the gas 24, for example after reception of particularly cold liquids which take heat away from the enclosed gas 24 and, as a result, reduce the pressure thereof.

Figure 3B:
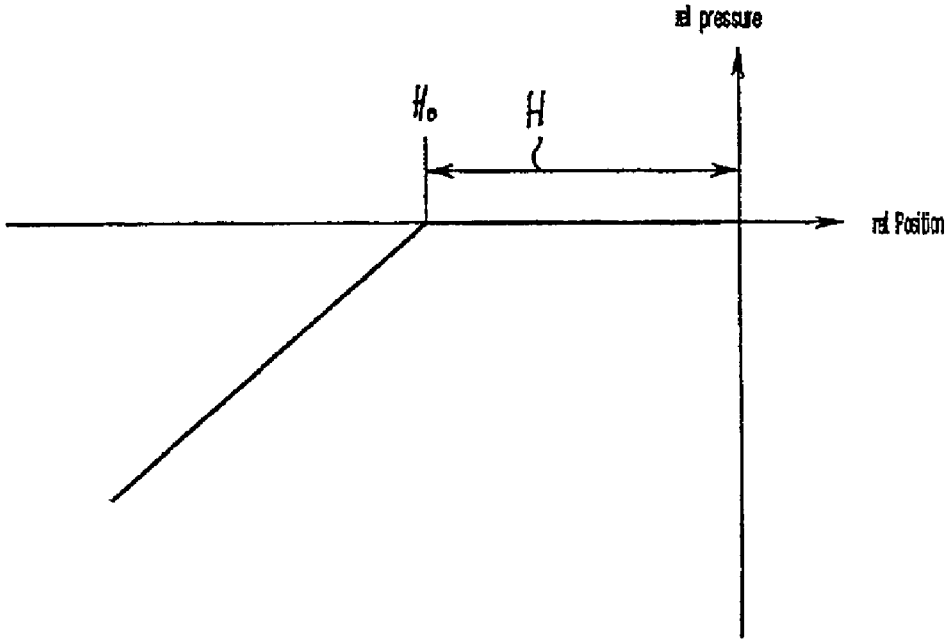

FIGS. 3*a* and 3*b* show signal profiles as can be supplied by the pressure sensor 26 via the data line 28 to the regulating device 30 during the determining of a mechanical play of the drive 32 and of the plunger 14. In this case, the relative pressure of the gas 24 is plotted over the relative position of the drive 32 during movement of the plunger 14 in the direction of the double arrow K. It can easily be seen that instead of relative values it is also possible for the absolute pressure of the gas 24 to be plotted over an absolute position of the drive 32. The relative pressure may be based, for example, on the ambient pressure which is detected by a further sensor. The relative position may be based on any desired position of the plunger, for example an upper or lower dead-center position.

The origin of the coordinates of each illustration of FIG. 3*a* and 3*b* marks the point of a reversal of the direction of movement of the plunger. In FIG. 3*a*, the plunger is moved over the distance U toward the opening 22 of the pipette tip 18 until, at the relative position $U_0$, a rise can be detected in the relative pressure of the gas 24 of the vessel, which is dipped into a liquid or is sealed in some other way. This means that a movement of the drive 32 causes a movement of the plunger 14 and therefore a rise of pressure of the gas 24 from the moment at which the drive, after the suction movement of the plunger has taken place, has negotiated the distance U during movement in the ejection direction.

FIG. 3*b* illustrates the determining of the play during a suction movement, i.e. during a raising of the plunger 14 away from the opening 22 of the pipette tip 18. In this case, the drive 32, after driving the plunger 14 away from the opening 22, first of all has to negotiate the play distance H until, at a point $H_0$, the driving movement actually also results in a movement of the plunger, so that, after the play distance H is exceeded, a further actuation of the drive results in a dropping of the pressure of the gas 24 in the vessel, which is dipped in or is sealed in some other way.

The play distances U and H, which can thus be individually determined for each metering device 10, can be stored in the memory 34 of the regulating device 30. The accuracy of the drive controlling means can be further increased by the movement plays being determined as a function of further variables and being stored retrievably in the memory 34. For example, the movement plays can be stored in the memory 34 as a function of direction and/or as a function of the plunger position and/or as a function of temperature and/or as a function of pressure, etc.

We claim:

1. A liquid-metering device for aspirating and dispensing liquids, the device comprising:

a vessel which is at least partially filled with a gas and has an opening through which a liquid is received into the vessel or is discharged therefrom, the gas, when the liquid is received, being enclosed by vessel walls and the liquid itself;

a gas-pressure-changing device for changing the gas pressure in said vessel;

a state-variable-detecting device for detecting at least one state variable of the gas in said vessel; and a control device which activates said gas-pressure-changing device as a function of the state variable detected by said state-variable-detecting device, wherein said control device is a regulating device which, at least during a regulating time segment between liquid reception and liquid discharge, activates said gas-pressure-changing device as a function of the detected state variable in such a manner that the actual gas pressure in said vessel is kept essentially at a predetermined desired gas pressure during the regulating time segment, and further, wherein the regulating time segment comprises a time domain in a first half of a period of time lying between a final moment of a liquid-receiving operation and a moment of starting a liquid-discharging operation.

2. A liquid-metering device for aspirating and dispensing liquids, the device comprising:

a vessel which is at least partially filled, with a gas and has an opening through which a liquid is received into the vessel or is discharged therefrom, the gas, when the liquid is received, being enclosed by vessel walls and the liquid itself;

a gas-pressure-changing device for changing the gas pressure in said vessel;

a state-variable-detecting device for detecting at least one state variable of the gas in said vessel; and a control device which activates said gas-pressure-changing device as a function of the state variable detected by said state-variable-detecting device, wherein said control device is a regulating device which, at least during a regulating time segment between liquid reception and liquid discharge, activates said gas-pressure-changing device as a function of the detected state variable in such a manner that the actual gas pressure in said vessel is kept essentially at a predetermined desired gas pressure during the regulating time segment, and further, wherein the regulating time segment comprises a first quarter of a period of time lying between a final moment of a liquid-receiving operation and a moment of starting a liquid-discharging operation.

3. A method for avoiding losses of drops in a liquid-metering device, comprising the following steps which are carried out at least in one time segment between a liquid-receiving operation and a liquid-discharging operation:

detecting at least one state variable of a gas, which is substantially enclosed between vessel walls of a vessel of a liquid-metering device and a liquid received in the vessel; and regulating a pressure of the gas as a function of a state variable detected in such a manner that as actual gas pressure substantially corresponds with a predetermined desired gas pressure, wherein said detecting step and said regulating step take place during a regulating time segment which comprises a time domain in a first half of a period of time lying between a final moment of a liquid-receiving operation and a moment of starting a liquid-discharging operation.

* * * * *